United States Patent [19]

Tanaka

[11] Patent Number: 4,596,481

[45] Date of Patent: Jun. 24, 1986

[54] SHEET ASSEMBLY FOR POLISHING WORK

[75] Inventor: Koichi Tanaka, Nagoya, Japan

[73] Assignee: Nihon Smart Kabushiki Kaisha, Japan

[21] Appl. No.: 679,104

[22] Filed: Dec. 7, 1984

Related U.S. Application Data

[63] Continuation of Ser. No. 407,882, Aug. 13, 1982, abandoned.

[30] Foreign Application Priority Data

Nov. 2, 1981 [JP] Japan ..... 56-174498
Dec. 9, 1981 [JP] Japan ..... 56-197010

[51] Int. Cl.[4] ..... A47L 13/19; A47L 13/17

[52] U.S. Cl. ..... 401/132; 401/7; 401/8

[58] Field of Search ..... 401/7, 8, 132, 196

[56] References Cited

U.S. PATENT DOCUMENTS

| | | | |
|---|---|---|---|
| 1,896,941 | 2/1933 | Cohen | 401/7 |
| 2,044,428 | 6/1936 | Gilmer | 401/8 |
| 2,790,982 | 5/1957 | Schneider | 401/7 |
| 3,053,385 | 9/1962 | Spees | 401/132 X |
| 3,081,480 | 3/1963 | Green | 401/7 |
| 3,306,292 | 2/1967 | Spees | 401/132 X |
| 3,635,567 | 1/1972 | Richardson, Jr. | 401/132 |
| 3,806,260 | 4/1974 | Miller | 401/7 |
| 3,826,259 | 7/1974 | Bailey | 401/132 X |

FOREIGN PATENT DOCUMENTS

| | | | |
|---|---|---|---|
| 899016 | 6/1962 | United Kingdom | 401/107 |

*Primary Examiner*—Steven A. Bratlie

[57] ABSTRACT

A sheet assembly for polishing work is provided. A non-woven fabric sheet and a non-permeable thick sheet are bonded together to define a first chamber. Further, a second chamber to contain a shoe polish therein is defined within said first chamber by a non-permeable but easily rupturable film such as a polyethylene sheet. The non-woven fabric sheet or the non-permeable thick sheet is formed with apertures therein. The shoe polish contained in the second chamber is discharged therefrom and further through the apertures to the outside of the sheet assembly when manually pressed from outside such that the shoe polish is ready for application onto shoes such that the shoes are shined by use of the non-woven fabric portion.

10 Claims, 13 Drawing Figures

SHEET ASSEMBLY FOR POLISHING WORK

This application is a continuation of application Ser. No. 407,882, filed Aug. 13, 1982 now abandoned.

BACKGROUND OF THE INVENTION

The present invention relates to a sheet assembly for simple and quick manual work of applying a polish or like composition to a desired object and polishing it. The object to be polished may be a shoe, a car or furniture, for example.

Sheets impregnated with polishing oil of known types are typically furnished with in hotel rooms or the like for free service for cleaning shoes. Such sheets, however, are not of the nature which positively give shoes their original gloss since the oil is not a shoe polish, though capable of achieving the cleaning function only.

A sheet assembly for polishing work embodying the present invention can carry a shoe polish in itself and, therefore, perform regular shoe polishing work in addition to the simple cleaning work. This allows shoes to be polished positively, easily and quickly.

SUMMARY OF THE INVENTION

It is an object of the present invention to provide a portable sheet assembly which can readily and quickly polish a desired object such as a shoe, a baseball glove or furniture or even avoid fogging of glass when applied thereto. In order to achieve this object, the sheet assembly of the present invention is provided with a portion for retaining an intended composition for polishing work, which may thus be a shoe polish or like polishing material, wax for preservation of hide, or antifogging material. Such sheet assemblies will prove desirable when installed in rooms for free service.

DETAILED DESCRIPTION OF THE EMBODIMENTS

Preferred embodiments of the present invention will be described hereunder with reference to the accompanying drawings.

Figure 1:
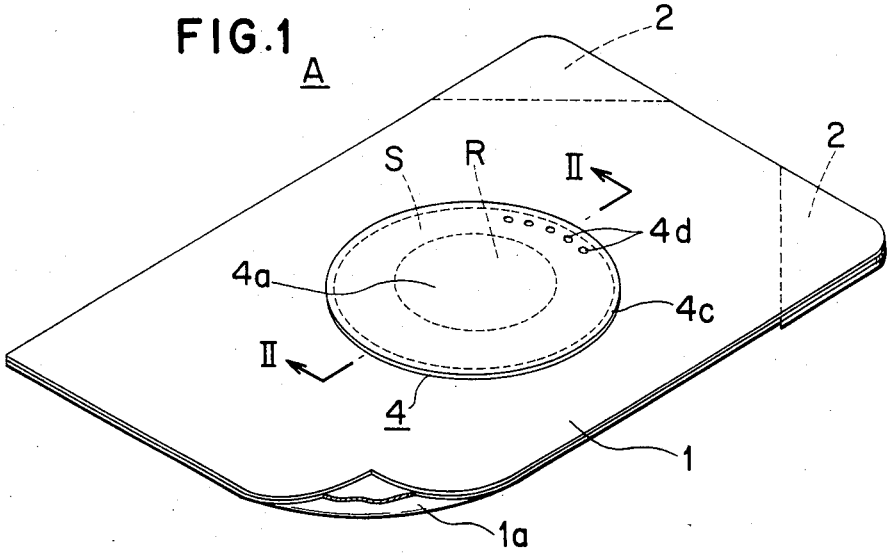
FIG. 1 is a perspective view of a sheet assembly for polishing work embodying the present invention.
Figure 2:
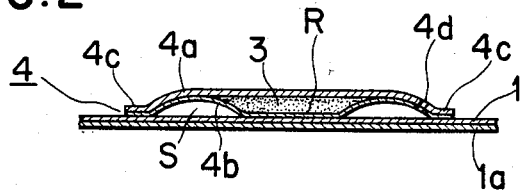
FIG. 2 is a section taken along line II—II of FIG. 1.

Referring to FIGS. 1 and 2, a sheet assembly for polishing work embodying the present invention is shown and generally designated by the reference character A. The sheet assembly A includes a sheet 1 which may be a Japanese paper or a non-woven fabric having a surface and an interfilament spacing as rough as those of a Japanese paper. Said sheet 1 has a first side and a second side.

A sheet lamination 4 is bonded to the first side of the sheet 1 along its peripheral edge **4*c* by welder means or adhesive means, in such a manner that a dispersion space S is defined between the sheet lamination 4 and sheet 1 which form a first chamber. The sheet lamination 4 is made up of a non-permeable relatively thick and strong outer film 4*a* such as of plastic or aluminum material and a non-permeable relatively thin and weak inner film 4*b* such as of plastic material (preferably polyethylene), which define a sealed second chamber R therebetween. A composition 3 such as a polish is filled in the sealed chamber R. Both the outer and inner films 4*a* and 4*b* are made of transparent or translucent synthetic resin such as polyethylene. The sheet lamination 4 is formed with a plurality of apertures 4*d* at one of its diametrically opposite portions in order to allow the filler 3 to come out therethrough, as will be described later. The second side of the sheet 1 is coated with a thin layer 1*a* of polyvinyl chloride or like synthetic resin. Pockets 2 for receiving a user's fingers are formed on said second side of the sheet 1**.

Figure 3:
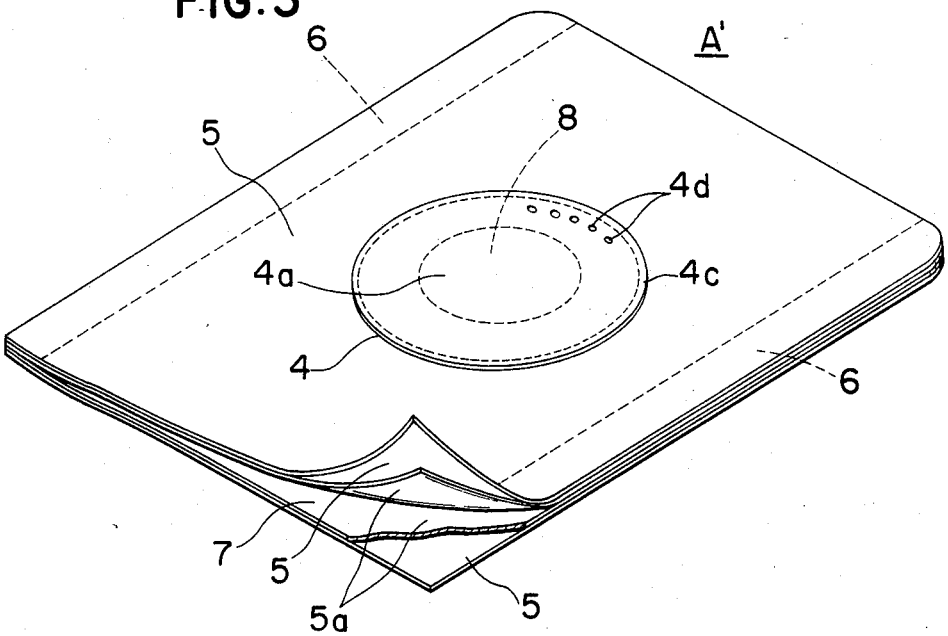
FIG. 3 is a perspective view of another embodiment of the present invention.

Referring to FIG. 3, a sheet assembly A' according to another embodiment of the present invention includes first and second non-woven fabric sheets 5 whose facing or inner surfaces are individually coated with layers **5*a* of synthetic resin. The sheets 5 are bonded together through the layers 5*a* by welder means along preselected opposite edges thereof as at 6. The rest of the sheets 5 spanning the bonded edges 6 forms a pocket or sack 7** into which fingers can be inserted.

One of the sheets 5 carries on a first side thereof the sheet lamination 4 for storing the filler which may be a shoe polish 8 in this embodiment, though the manner of storage of the filler is identical with that of the first embodiment. The position of the sheet lamination 4 is such that it will be backed through sheet 5 by fingers which are inserted into the pocket 7.

In use, the sealed chamber R of the sheet lamination 4 is strongly pressed from behind by fingers to rupture the inner film **4*b*. Then, the filler 3 or 8 is discharged from the chamber R into the dispersion space S and, therefrom, to the outside of the sheet assembly via the apertures 4*d* by further pressing action of the fingers. The filler 3 or 8 on the sheet 1 or 5** is now ready to be applied to a desired object such as shoes.

Figure 4:
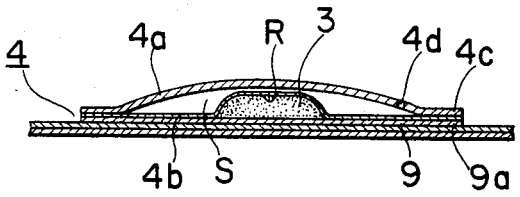
FIGS. 4 and 5 are sections showing further different embodiments of the present invention.

FIG. 4 shows a further embodiment of the present invention in which a retainer sheet 9 defines the sealed chamber R for storing the filler. The sheet lamination 4 composed of sheet **4*a* and polyethylene film 4*b* is laid on the retainer sheet 9 and bonded together therewith to the sheet 1 along aligned edges 4*c* and 9*a* of the sheet lamination 4 and sheet 9**.

Figure 5:
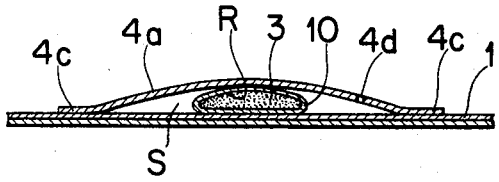

FIG. 5 illustrates a still further embodiment of the present invention which employs a capsule 10 for defining the sealed chamber R. The capsule 10 is movably disposed in the space S which is defined between the non-woven fabric sheet 1 and sheet lamination 4. Said capsule 10 is made of polyethylene film.

Figure 6:
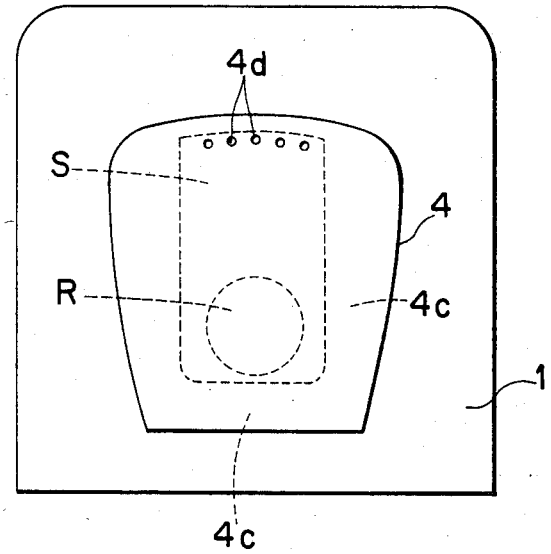
FIG. 6 is a plan view of a still further embodiment of the present invention.

FIG. 6 shows a still further embodiment of the present invention which is designed to facilitate discharge of the filler to the outside of the sheet assembly. The sheet lamination 4 in FIG. 6 is bonded to the sheet 1 throughout its major area except for the sealed chamber R and the space S which is directed to the apertures **4*d***.

Figure 7:
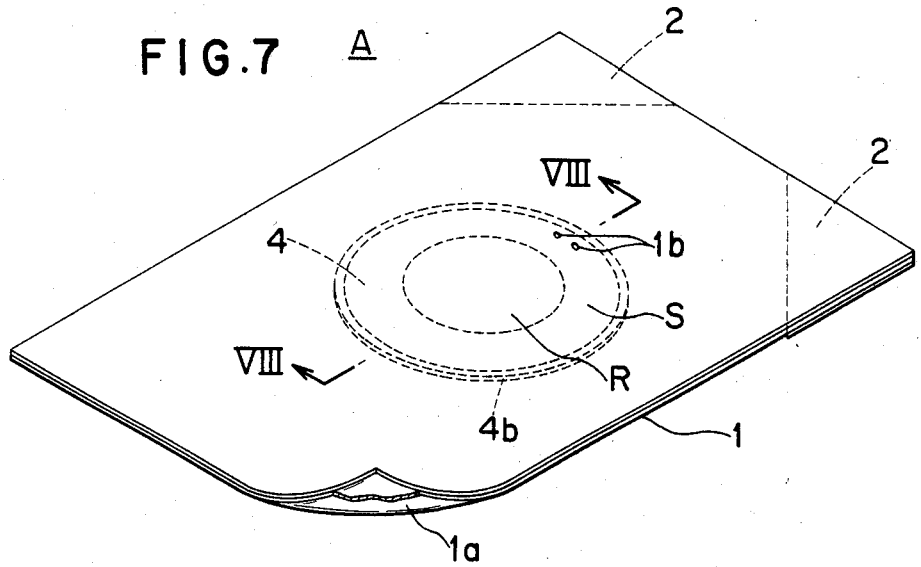
FIG. 7 is a perspective view of a still further embodiment of the present invention.
Figure 8:
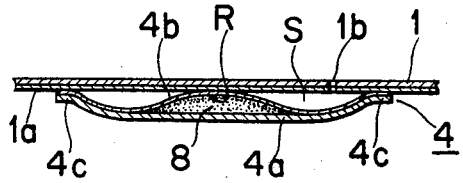
FIG. 8 is a section taken along line VIII—VIII of FIG. 7.

Referring to FIGS. 7 and 8, a still further embodiment will be described hereinafter. The first side of the sheet 1 is coated with a thin layer 1*a* of polyvinyl chloride or like synthetic resin. Pockets 2 for receiving fingers are formed on the same side of the sheet 1 which has the layer 1*a* thereon. The sheet 1 carries a sheet lamination on its first side which has the layer 1*a*. The sheet lamination 4 comprises a non-permeable relatively thick and strong film 4*a* such as a film of transparent or translucent synthetic resin typified by polyethylene or a foil of metal typified by aluminum. A non-permeable film 4*b* of synthetic resin is positioned inside the sheet 4*a* to define a sealed second chamber R in cooperation with the latter. The film 4*b* is shaped to be relatively thin and weak. A composition 3, which may be a polish for example, is filled in the sealed second chamber R. The sheet lamination 4 is bonded to the sheet 1 along its peripheral edge 4*c* by welder means or adhesive means, while defining a dispersion space S therebetween forming a first chamber. The sheet 1 is formed with a plurality of apertures 1*b* in its area which corresponds to the dispersion space S. The filler 3 will come out through the apertures 1*b* when the sheet assembly is in use, as will be described later.

Figure 9:
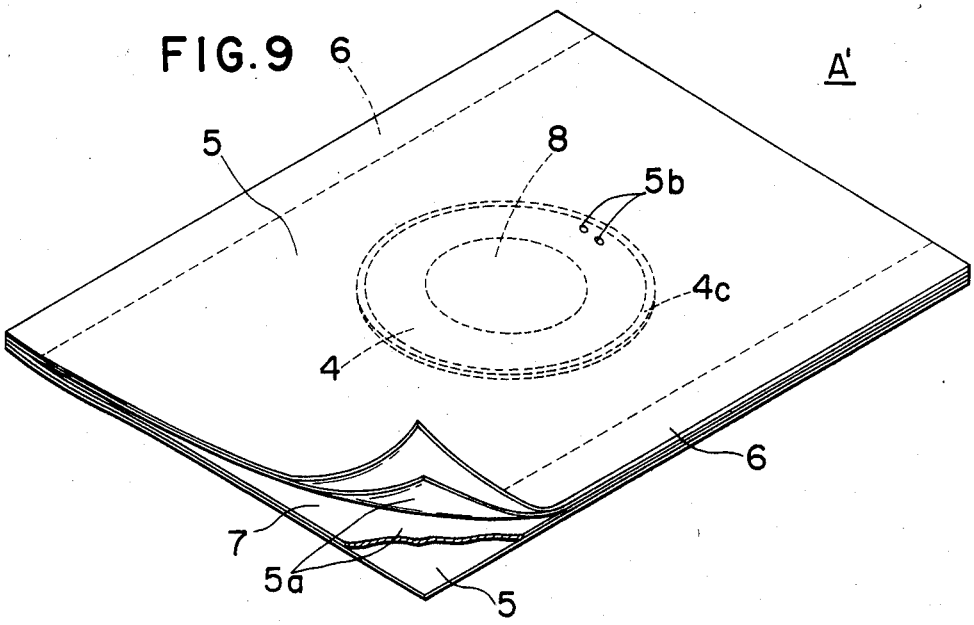
FIG. 9 is a perspective view of a still further embodiment of the present invention.

Referring to FIG. 9, a sheet assembly A' according to a still further embodiment includes first and second nonwoven fabric sheet 5 whose facing or inner sides are individually coated with layers 5*a* of synthetic resin. The sheets 5 are bonded together through the layers 5*a* by welder means along preselected opposite edges thereof as at 6. The rest of the sheets 5 spanning the bonded edges 6 forms a pocket or sack 7 into which fingers can be inserted. One of the sheets 5 carries on its first side the sheet lamination 4 for storing the filler 8 which may be a shoe polish 8 in this embodiment, though the manner of storage of the filler is identical with that of the previous embodiment. The position of the sheet lamination 4 is such that it will be covered by fingers when the fingers are inserted into the pocket 7. This sheet 5 is formed with apertures 5*b* in its area which corresponds to the space S, in order to allow the passage of the filler 8 to the outside of the sheet assembly.

In use, the sealed chamber R of the sheet lamination 4 is strongly pressed from behind by fingers to rupture the inner film 4*a*. Then, the filler 3 or 8 is dislodged from the chamber R into the space S and, therefrom, to the second side of the sheet 1 or 5 via the apertures 1*b* or 5*b*. The filler 3 or 8 on the sheet 1 or 5 is now ready to be applied to a desired object such as shoes.

If desired, the apertures serving as outlets for the filler may be replaced by cuts or the like.

Figure 10:
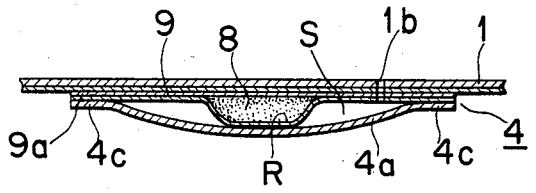
FIGS. 10, 11, 12 and 13 are sections of still further embodiments of the present invention.

FIG. 10 shows a still further embodiment of the present invention in which a retainer sheet 9 defines the sealed chamber R for storing the filler. The sheet lamination 4 is laid on the retainer sheet 9 and bonded together therewith to the sheet 1 along aligned edges 4*c* and 9*a* of the sheets 4 and 9.

Figure 11:
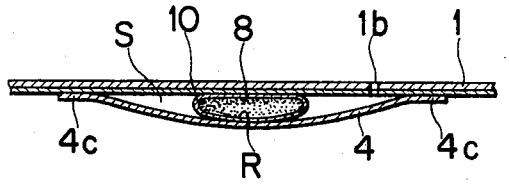

FIG. 11 illustrates a still further embodiment of the present invention which employs a polyethylene capsule 10 for defining the sealed chamber R. The capsule 10 is movably disposed in the space S which is defined between the sheets 1 and 4.

Figure 12:
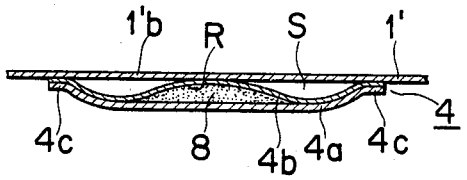

FIG. 12 shows a still further embodiment of the present invention wherein use is made of a sheet 1' constituted by a piece of non-woven fabric having a relatively rough filament structure, which permits the filler 8 to easily infiltrate thereinto. In this structure, a portion 1'*b* of the sheet 1 which overlies the space S serves as an outlet for the filler 3. The filler 3 will progressively ooze out through the sheet portion 1'*b* as the sheet assembly is rubbed against an intended object.

Figure 13:
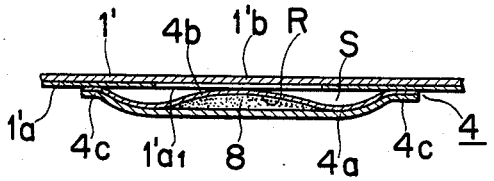

FIG. 13 shows a still further embodiment of the present invention which includes a layer of synthetic resin 1'*a* coated on the first side of a sheet 1', in addition to the structural elements shown in FIG. 12. The layer 1'*a* is formed with an opening $1'a_1$ in its outlet portion 1'*b*.

Although the second chamber R sealing a polishing composition therein is adapted to be pressed by a user's fingers in the foregoing embodiments, a length of string may be attached to the relatively thin polyethylene film defining the chamber R to extend outside the sheet assembly such that the thin polyethylene film is broken by pulling the string from outside the sheet assembly.

In summary, it will be seen that a sheet assembly for polishing work of the present invention is portable and convenient for storage and can be used easily and quickly for various purposes such as shining shoes or keeping glass from a cloud.

It will also be seen that the sheet assembly prevents degeneration of a shoe polish or like composition over a long period of time, because the composition is retained in a sealed second chamber inside a first chamber.

What is claimed is:

1. A sheet assembly for polishing work comprising:

first sheet means having a generally planar structure and defining a first chamber therein;

second sheet means provided in said first chamber for defining a second chamber therein in an air-tightly sealed condition, said first sheet means and said second sheet means being bonded together to define a dispersion chamber therebetween; and a polishing composition filled in said second chamber, said second sheet means being formed of a plastic material rupturable when said seond chamber is manually applied with force from outside the dispersion chamber to discharge said polishing composition into the dispersion chamber in a dispersed manner, said first sheet means having at least one aperture comprising an outlet from said dispersion chamber and located at a position remote from the second chamber for further discharging said polishing composition out of the dispersion chamber when further pressed from outside the dispersion chamber manually.

2. A sheet assembly according to claim 1, wherein said first sheet means includes a non-woven fabric sheet having a first side and a second side; and a non-permeable relatively thick film bonded to said non-woven fabric sheet on said first side along a peripheral edge of said relatively thick film.

3. A sheet assembly according to claim 2, wherein said second sheet means includes a non-permeable relatively thin film lined to said non-permeable relatively thick film such that a portion of said non-permeable relatively thin film defines said second chamber in cooperation with the non-permeable relatively thick film.

4. A sheet assembly according to claim 3, wherein said non-permeable relatively thin and thick films are of plastic material.

5. A sheet assembly according to claim 3, wherein said at least one aperture is formed in said relatively thick film.

6. A sheet assembly according to claim 5, further including at least one pocket for receiving a user's fingers, said pocket being formed on said second side of the non-woven fabric sheet.

7. A sheet assembly according to claim 3, wherein said at least one aperture is formed in said non-woven fabric sheet.

8. A sheet assembly according to claim 7, further including at least one pocket for receiving a user's fingers, said pocket being formed on said first side of the non-woven fabric sheet.

9. A sheet assembly according to claim 2, wherein said non-woven fabric sheet is coated with a plastic layer on said first side thereof.

10. A sheet assembly according to claim 9, wherein said seoond sheet means includes a relatively thin film lined to said plastic layer such that a portion of said relatively thin film defines said second chamber in co-operation with the plastic layer.

* * * * *